US007063808B1

(12) United States Patent
Viswanathan

(10) Patent No.: US 7,063,808 B1
(45) Date of Patent: Jun. 20, 2006

(54) LIGNOSULFONIC ACID-DOPED POLYANILINE COMPOSITES WITH CARBON ALLOTROPES

(75) Inventor: Tito Viswanathan, Little Rock, AR (US)

(73) Assignee: Poly One Corporation, Avon Lake, OH (US)

( * ) Notice: Subject to any disclaimer, the term of this patent is extended or adjusted under 35 U.S.C. 154(b) by 0 days.

(21) Appl. No.: 10/819,742

(22) Filed: Apr. 7, 2004

Related U.S. Application Data

(60) Provisional application No. 60/461,156, filed on Apr. 7, 2003.

(51) Int. Cl.
*H01B 1/04* (2006.01)
*H01B 1/12* (2006.01)

(52) U.S. Cl. ..... 252/500; 252/511

(58) Field of Classification Search ..... 252/500, 252/502, 510, 511; 525/54.1; 528/210, 528/214, 422
See application file for complete search history.

(56) References Cited

U.S. PATENT DOCUMENTS

| | | | |
|---|---|---|---|
| 3,546,155 | A | 12/1970 | Chandler |
| 3,748,172 | A | 7/1973 | Speirs et al. |
| 3,862,851 | A | 1/1975 | Speirs et al. |
| 4,009,131 | A | 2/1977 | Farone |
| 4,048,136 | A | 9/1977 | Kobayashi et al. |
| 4,086,153 | A | 4/1978 | Ariga et al. |
| 4,130,469 | A | 12/1978 | McGinniss |
| 4,140,816 | A | 2/1979 | McGinniss |
| 4,163,810 | A | 8/1979 | McGinniss |
| 4,518,726 | A | 5/1985 | Kato et al. |
| 5,069,820 | A | 12/1991 | Jen et al. |
| 5,160,457 | A | 11/1992 | Elsenbaumer |
| 5,217,649 | A | 6/1993 | Kulkarni et al. |
| 5,274,021 | A | 12/1993 | Geeck et al. |
| 5,281,363 | A | 1/1994 | Shacklette et al. |
| 5,290,483 | A | 3/1994 | Kulkarni et al. |

(Continued)

FOREIGN PATENT DOCUMENTS

| | | |
|---|---|---|
| DE | 28 54 696 | 7/1980 |

(Continued)

OTHER PUBLICATIONS

*Polymeric Materials: Science & Engineering*2002, 86, 233 (Apr. 7, 2002).

(Continued)

*Primary Examiner*—Mark Kopec
(74) *Attorney, Agent, or Firm*—John H. Hernickel

(57) ABSTRACT

The present invention relates to a composite made up of a conductive carbon material and lignosulfonic acid-doped polyaniline, wherein the composite possesses a conductivity greater than the conductivity of the polyaniline and the conductive carbon material. It also relates to a method of preparing a conductive carbon material-lignosulfonic acid-doped polyaniline composite by polymerizing aniline in the presence of the conductive carbon material and lignosulfonate. In addition, this invention relates to a composite made up of a conductive carbon material and sulponated asphalt-polyaniline, wherein the composite possesses a conductivity greater than the conductivity of the conductive carbon material and the sulponated asphalt-polyaniline. It also relates to a method of preparing a conductive carbon material-sulponated asphalt-polyaniline composite by polymerizing aniline in the presence of the conductive carbon material and the sulfonated asphalt.

7 Claims, 3 Drawing Sheets

Conductivity study of graphite/LIGNO-PANI composites: ● – doped GLP, ○ – dedoped GLP.

U.S. PATENT DOCUMENTS

| | | | | |
|---|---|---|---|---|
| 5,456,862 | A | 10/1995 | Kwan-Yen et al. | |
| 5,532,025 | A | 7/1996 | Kinlen et al. | |
| 5,567,355 | A | 10/1996 | Wessling et al. | |
| 5,645,890 | A | 7/1997 | MacDiarmid et al. | |
| 5,648,416 | A | 7/1997 | Miller et al. | |
| 5,658,649 | A | 8/1997 | Wrobleski et al. | |
| 5,853,462 | A | 12/1998 | Spellane et al. | |
| 5,853,621 | A | 12/1998 | Miller et al. | |
| 5,871,671 | A | 2/1999 | Kinlen et al. | |
| 5,968,417 | A | 10/1999 | Viswanathan | |
| 5,976,419 | A | 11/1999 | Hawkins et al. | |
| 6,059,999 | A | 5/2000 | Viswanathan | |
| 6,231,789 | B1 | 5/2001 | Hawkins et al. | |
| 6,299,800 | B1 | 10/2001 | Viswanathan | |
| 6,440,332 | B1 | 8/2002 | Geer et al. | |
| 6,569,651 | B1 * | 5/2003 | Samuelson et al. | 435/128 |
| 6,627,117 | B1 | 9/2003 | Geer et al. | |
| 6,764,617 | B1 * | 7/2004 | Viswanathan et al. | 252/500 |
| 2002/0195592 | A1 | 12/2002 | Geer et al. | |
| 2004/0232390 | A1 | 11/2004 | Viswanathan | 252/500 |

FOREIGN PATENT DOCUMENTS

| | | |
|---|---|---|
| GB | 1494212 | 12/1974 |
| JP | 59075943 | 4/1984 |
| JP | 7103185 | 4/1995 |
| JP | 08277370 | 10/1996 |
| WO | WO-99/64524 | 12/1999 |

OTHER PUBLICATIONS

*Polymeric Materials: Science & Engineering*2002, 86, 233 (Mar. 4, 2002).

* cited by examiner

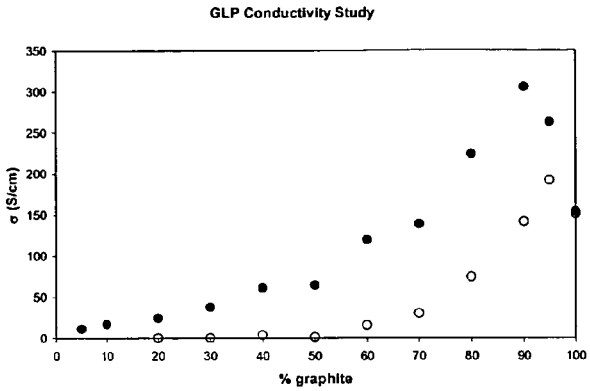
Figure 1 Conductivity study of graphite/LIGNO-PANI composites: ● – doped GLP, ○ – dedoped GLP.

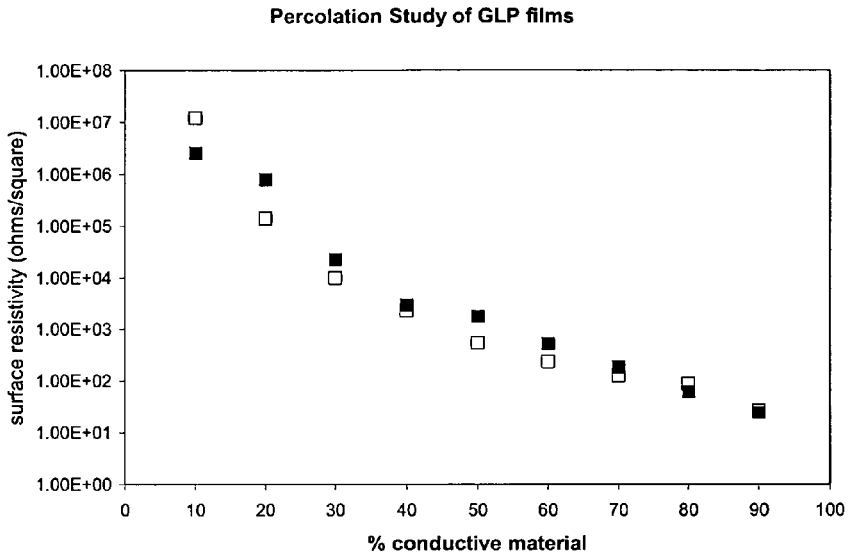
Figure 2 Surface resistivity of composite films versus percent composite: ■ – 80/20 GLP, □ – 70/30 GLP.

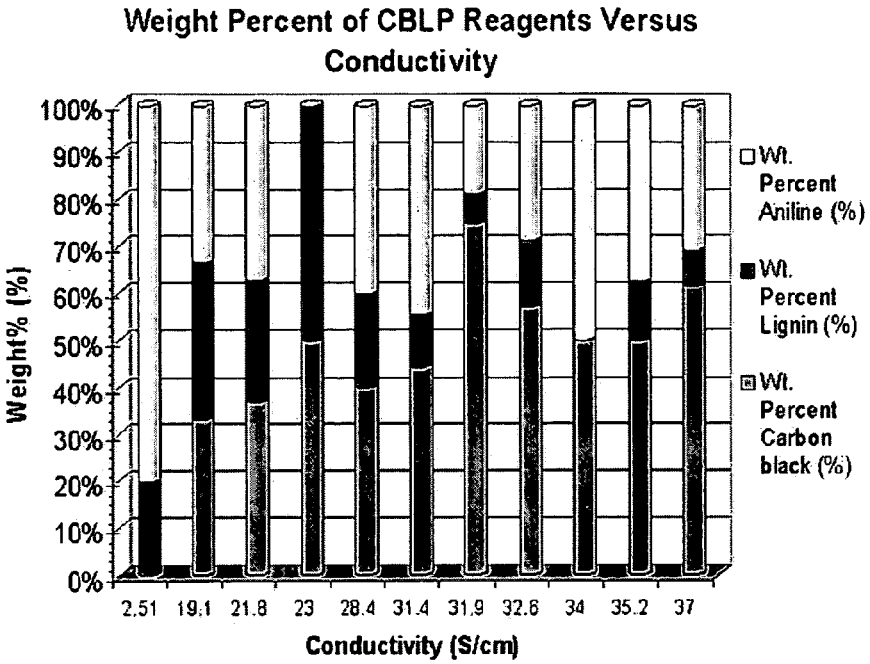
Figure 3 Conductivity of carbon black-Ligno-PANi$^{TM}$ composites with varying ratios of aniline, lignosulfonate, and carbon black

LIGNOSULFONIC ACID-DOPED POLYANILINE COMPOSITES WITH CARBON ALLOTROPES

CLAIM OF PRIORITY

This patent application claims priority from provisional patent application Ser. No. 60/461,156, filed on Apr. 7, 2003.

FIELD OF THE INVENTION

This invention relates to compositions of carbon black or graphite and inherently conductive polymer composites that possess high conductivity and the synthesis thereof. The composite also possesses high dispersibility in a wide variety of solvents.

BACKGROUND OF THE INVENTION

Inherently conductive polymers (ICPs) are an important class of materials recognized by the Nobel Prize in Chemistry for the year 2000. Since the seminal publication (Shirakawa, Hideki; Louis, Edwin J.; MacDiarmid, Alan G.; Chiang, Chwan K.; Heeger, Alan J. *J. Chem. Soc. Chem. Commun.,* 1977, 578) in this field, many conducting polymers have been developed but few are available commercially. This in part is due to cost as well as insufficient dispersibility. See (Gregory, Richard V. *Chapter* 18*: Solution Processing of Conductive Polymers: Fibers and Gels from Emeraldine BasePolyaniline* in *Handbook of Conducting Polymers*, Eds. Skotheim, Terje A.; Elsenbaumer, Ronald L.; Reynolds, John R.; MarcelDekker Inc., 1998; p. 437) for many applications. Also see, Lignosulfonic Acid-Doped Polyaniline (Viswanathan, T. "Conducting Compositions of Matter", U.S. Pat. No. 6,299,800 (2001)).

LIGNO-PANI™, however, is an inexpensive dispersible ICP available commercially on an industrial scale (http://www.polyone.com). The decreased cost as well as increased dispersibility of LIGNO-PANI™ is due to the incorporation of lignosulfonic acid as a polymeric dopant/template (Sudhakar, M.; Toland, A. D.; Viswanathan, T. *Chapter* 6. *Conducting Waterborne Lignosulfonic Acid-Doped Polyaniline in Semiconducting Polymers*. Eds. Hsieh, Bing R.; Wei, Yen; American Chemical Society, 1999; p. 76).

Lignin, a renewable resource, is a waste product from the paper industry. The sulfonated form of lignin is therefore inexpensive and highly water soluble. An important property of LIGNO-PANI™ is that the polymeric dopant is permanently incorporated into the ICP resulting in electroactivity at higher pH values than other polyanilines (Berry, B. C.; Shaikh, A. U.; Viswathan, T. ACS *Polymer Preprints*. 2000, 41, 327). Composites of ICPs and carbon black have also been explored (Avlyanov, J., Dahman, S. *Chapter* 17. *Thermally Stable Intrinsically Conductive Polymer-Carbon Black Composites as New Additives for Plastics in Semiconducting Polymers*. Eds. Hsieh, Bing R.; Wei, Yen; American Chemical Society, 1999; p. 76). These composites demonstrate high conductivities as well as improved properties over carbon black alone for some applications.

Carbon black and graphite possess good conductive properties but are highly insoluble in aqueous and organic systems. Composites of carbon black and inherently conductive polymers (ICPs) such as polyaniline (PANi) have been studied but the conductivity of these composites is limited to the conductivity of the PANi. For example, U.S. Pat. No. 5,498,372 to Hedges discloses a carbon allotrope composite formed with an ICP having a highest conductivity of the conducting polymer component. (U.S. Pat. No. 5,498,372, 1996, to Hedges). These prior art composites presented an advance over existing technology because the carbon black/ICP composites allowed for easy control of resistivity in the range needed for electrostatic dissipation (ESD). Furthermore, the prior art composites exhibited improved thermal stability over existing technology at the time (see, Avlyanov, J., Dahman, S. *Chapter* 17. *Thermally Stable Intrinsically Conductive Polymer-Carbon Black Composites as New Additives for Plastics in Semiconducting Polymers*. Eds. Hsieh, Bing R.; Wei, Yen; American Chemical Society, 1999; p. 76). Highly conductive carbon/ICP composites are desirable for the increased resistivity control and better thermal stability, however, a considerable need exists in the art for a dispersible composite that possesses high conductivity.

SUMMARY OF THE INVENTION

The present invention provides a composite of highly conductive forms of carbon and lignosulfonic acid doped polyaniline (LIGNO-PANi™). The carbon composite is also dispersible in a wide range of solvents and resins. It has also been found that certain formulations of the composite have conductivities higher than the conductivities of the individual ingredients making up the composite. In other words, the present invention relates to a composite made up of a conductive carbon material and lignosulfonic acid-doped polyaniline, wherein the composite possesses a conductivity greater than the conductivity of the polyaniline and the conductive carbon material. It also relates to a method of preparing a conductive carbon material-lignosulfonic acid-doped polyaniline composite by polymerizing aniline in the presence of the conductive carbon material and lignosulfonate. In addition, the present invention relates to a composite made up of a conductive carbon material and sulponated asphalt-polyaniline, wherein the composite possesses a conductivity greater than the conductivity of the conductive carbon material and the sulponated asphalt-polyaniline. It also relates to a method of preparing a conductive carbon material-sulponated asphalt-polyaniline composite by polymerizing aniline in the presence of the conductive carbon material and the sulfonated asphalt.

BRIEF DESCRIPTION OF THE DRAWINGS

The features and advantages of the present invention will become more readily apparent from the following detailed description of the invention in which:

FIG. 1 is a graphical depiction of a conductivity study of doped and dedoped graphite/LIGNO-PANi composite;

FIG. 2 is a graphical comparison of the surface resistivity of the composite versus percent composite of 80/20 Graphite Ligno-PANi composite and 70:30 Graphite Ligno-PANi composite; and FIG. 3 is a graphical representation of the conductivity of Carbon Black—Ligno-PANi composites with varying ratios of aniline, lignosulfonate, and carbon black.

DETAILED DESCRIPTION OF THE INVENTION

Carbon black has wide application in the electronics industry due to its conductive properties, but is highly insoluble in aqueous and most organic solvents. A dispersible carbon black that possesses high conductivity has wide applicability in a variety of fields such as, but not limited to, electrodes, ESD, electromagnetic interference shielding, and primers for plastics coated via electrospray methods. Some carbon black composites formed with inherently conducting polymers (ICPs) are known in the art to address the problem of achieving both conductivity and dispersibility. ICPs are an important class of materials recently recognized by the Nobel Prize in Chemistry in 2000. Many useful ICPs have been developed (see Shirakawa, Hideki; Louis, Edwin J.; MacDiarmid, Alan G.; Chiang, Chwan K.; Heeger, Alan J. *J. Chem. Soc. Chem. Commun.,* 1977, 578), but few are available commercially. This limited availability may be due to cost as well as insufficient dispersibility of some ICPs for many applications (see Gregory, Richard V. *Chapter* 18*: Solution Processing of Conductive Polymers: Fibers and Gels from Emeraldine Base Polyaniline in Handbook of Conducting Polymers*, Eds. Skotheim, Terje A.; Elsenbaumer, Ronald L.; Reynolds, John R.; Marcel Dekker Inc., 1998; p. 437).

Composites of ICP and carbon black were explored as viable alternatives to the use of polyaniline (PANi), polypyrrole (PPy) and carbon black (CB) alone as conductive additives in the thermoplastics industry because each of these materials demonstrate undesirable properties at high temperatures (see Avlyanov, J., Dahman, S. *Chapter* 17. *Thermally Stable Intrinsically Conductive Polymer-Carbon Black Composites as New Additives for Plastics in Semiconducting Polymers*. Eds. Hsieh, Bing R.; Wei, Yen; American Chemical Society, 1999; p. 76). In particular, each of these materials when used alone as conductive additives displayed poor dispersibility. Resistivity was also difficult to control and conductivity of these materials often degraded when exposed to certain chemicals used in the thermoplastics industry. By stark contrast, when CB and PANi were combined the resultant composite was relatively more dispersible and the resistivity was relatively easy to control. It should be noted that although carbon black and certain ICPs such as PANi are not very dispersible some increased dispersibility was noted in the prior art composites. The conductivity of the prior art CB/PANi composites is below that of CB alone and about the same order of magnitude of PANi (see U.S. Pat. No. 5,498,372, 1996 to Hedges). The conductivity of these prior art CB/PANi composites varied only slightly with pH (see Avlyanov, J., Dahman, S. *Chapter* 17. *Thermally Stable Intrinsically Conductive Polymer-Carbon Black Composites as New Additives for Plastics in Semiconducting Polymers*. Eds. Hsieh, Bing R.; Wei, Yen; American Chemical Society, 1999; p. 76) which indicated that the ICP did not play a significant role in the conductivity. To elaborate, ICPs become insulating when dedoped therefore conductivity should vary in response to pH change. The slight variation of the conductivity of the CB/ICP composite in response to pH change aids in understanding the role of ICP in the overall inventive composites.

The present invention provides an advance in the art by providing a composite and the synthesis thereof, wherein the composite comprises a highly conductive carbon material and Lignosulfonic acid doped polyaniline (LIGNO-PANi™). A novel unexpected property of the composites of the present invention includes conductivity control through pH variation indicative of ICP contribution to conductivity. Furthermore, the inventive composites are dispersible and believed to be thermally stable. LIGNO-PANi™ (see Viswanathan, T. "Conducting Compositions of Matter", U.S. Pat. No. 6,299,800 (2001)) is an inexpensive dispersible ICP available commercially on an industrial scale. The presence of the water soluble lignosulfonate counter ion in LIGNO-PANi™ renders the polymer highly dispersible (see Sudhakar, M.; Toland, A. D.; Viswanathan, T. *Chapter* 6. *Conducting Waterborne Lignosulfonic Acid-Doped Polyaniline in Semiconducting Polymers*. Eds. Hsieh, Bing R.; Wei, Yen; American Chemical Society, 1999; p. 76). An important property of LIGNO-PANi™ is that the polymeric dopant is permanently incorporated into the ICP resulting in electroactivity at higher pH values than other polyanilines (see Berry, B. C.; Shaikh, A. U.; Viswanathan, T. ACS *Polymer Preprints.* 2000, 41, 327). The conductivity values of the inventive composites also demonstrated dependence upon pH variation (ranging from about 0 to 14) changes in contrast to prior art composites. The Graphite-LIGNO-PANi™ (GLP) composites possessed higher conductivity values in comparison to the other composites encompassed within the scope of this invention.

The conductivity of these composites was highly pH dependent allowing for control of conductivity in various applications. The following non-limiting examples demonstrate the art of making various carbon allotrope/LIGNO-PANi™ composites.

Because homogeneity is crucial to the synthesis of consistent composites, the polymerization of the monomer (aniline or pyrrole) in the synthesis of the composite was carried out in the presence of carbon allotropes which were already dispersed in water in the presence of lignosulfonate. Although the aforementioned synthesis was carried out in an aqueous environment, it is believed that the synthesis can also be carried out in the presence of organic dispersions of graphite. The carbon black composites demonstrated higher conductivities as well as improved properties over carbon black alone for some applications. Furthermore, the use of the graphite as a highly conducting matrix on which to polymerize aniline in presence of lignosulfonate led to composites with improved processibility and dispersability over those known in the art.

The weight percent ratio of carbon black or graphite: lignin:aniline is preferably from about 5:19:76 to 95:1:4. The conductivity values of GLP are preferably from about 5 to 275 S/cm. The conductivity values of the sulfonated asphalt polyaniline (SAP) are preferably from about 10 to 30 S/cm. The weight ratio and conductivity values of carbon black-Ligno-PANi™ composite (CBLP) are depicted in FIG. 3. The conductivity values for CBLP are preferably from about 2.5 to 37 S/cm. The resistivity values of the composites of GLP are preferably from about 1.00E0 to 1.00E10 ohms/square, and more preferably from about 1.00E01 to 1.00E07 ohms/square.

The materials obtained for the preparation of the examples discussed immediately below are as follows. A water dispersible colloidal graphite (~25–28% solids), carbon black (KETJENBLACK EC-600 JD obtained from Akzo Nobel), and sulfonated asphalt (obtained from Chevron Phillips) were used as the carbon moieties in the composites. Aniline, sodium persulfate, methanesulfonic acid (HMSA), and p-toluenesulfonic acid (p-TSA) were obtained from Aldrich Chemical Company. Sodium lignosulfonate (Reax 825E) was obtained from Westvaco.

EXAMPLE 1

The following composites of GLP were prepared as described immediately below:

Synthesis of 90/10 GLP:

A 36.0 g sample of colloidal graphite (25% solids in water), 25.0 mL of 1M HMSA, 0.25 g Reax 825E, and 1.00 mL aniline were added to a beaker. The solution was cooled to ~0° C. Then 2.62 g sodium persulfate was added. The reaction was allowed to stir overnight. The solution was then filtered by vacuum through a Whatman #4 filter paper and washed with distilled water. The cake was then washed twice with 50 mL 1M HMSA. The sample was dried under vacuum to determine percent solids of the wet cakes. The conductivity of the pressed pellet was 295 S/cm. The sample was dedoped by stirring the dry solids in 1M NaOH overnight, vacuum filtering through a Whatman #4 filter paper followed by extensive washing with distilled water. The conductivity of the dried dedoped sample was 140 S/cm.

EXAMPLE 2

Synthesis of 80/20 GLP:

A 32.0 g sample of colloidal graphite (25% solids), 50.0 mL of 1M HMSA, 0.50 g Reax 825E, and 2.00 mL aniline were added to a beaker. The solution was cooled to ~0° C. Then 5.24 g sodium persulfate was added. The reaction was allowed to stir overnight. The solution was then filtered by vacuum through a Whatman #4 filter paper and washed extensively with distilled water. The cake was then washed twice with 50 mL 1M HMSA. The sample was dried under vacuum to determine percent solids of the wet cakes. The conductivity of the pressed pellet was 223 S/cm. The sample was dedoped by stirring the dry solids in 1M NaOH overnight, vacuum filtering through a Whatman #4 filter paper, and washing extensively with distilled water. The conductivity of the dedoped sample was 75 S/cm.

Both bulk conductivities and film resistivities of the composite samples were determined. DC conductivity measurements were made on pressed pellets with an Alessi four-point conductivity probe connected to a Keithly voltmeter and programmable current source. Surface resistivities were determined by measuring the resistance across the film surface using 1 inch metal clips placed 1 inch apart.

While not wishing to be bound by theory, prior research with PANi/carbon nanotube composites suggests that an interaction of the quinoid ring of the PANi chain and the nanotube aids in charge transfer (Cochet, Murielle; Maser, Wolfgang K.; Benito, Ana M.; Callejas, M. Alicia; Martinez, M. Teresa; Benoit, Jean-Michel; Schreiber, Joachim; Chauvet, Olivier. Synthesis of a new polyaniline/nanotube composite: "in-situ" polymerisation and charge transfer through site-selective interaction, Chemical Communications (Cambridge, United Kingdom) (2001), (16), 1450–1451. CODEN: CHCOFS ISSN:1359-7345. CAN 135:331940 AN 2001:581362 CAPLUS.

The highest conductivities measured was 305 S/cm for a 90/10 GLP composite (FIG. 1). A dramatic decrease in conductivity occurred when the samples were dedoped. A change of 1 to 2 orders of magnitude is seen in some composites. Clearly, this variation due to pH change is quite different from the previously studied carbon black/ICP composites (see Avlyanov, J., Dahman, S. *Chapter* 17. *Thermally Stable Intrinsically Conductive Polymer-Carbon Black Composites as New Additives for Plastics in Semiconducting Polymers*. Eds. Hsieh, Bing R.; Wei, Yen; American Chemical Society, 1999; p. 76). As discussed previously, the prior art carbon black/ICP composite conductivity varied only slightly in response to pH change. This pH (in a range of variation of from about 0 to 14) dependence of the graphite composites indicates that the ICP plays a significant role in the mechanism of conduction in these composite materials. When ICPs are dedoped, they become insulating. Therefore, if the ICP is playing a significant role in the conductivity of the composite, the conductivity should change dramatically when it is dedoped (in an alkali environment). As mentioned earlier, CB-PANi prior art composites did not demonstrate this dependence therefore, the strong pH dependency of GLP and carbon black-LIGNO-PANi™ (CBLP) conductivity was an unexpected and novel property of the present invention.

EXAMPLE 3

Synthesis of 80/20 GLP Doped with p-TSA:

A 32.0 g sample of colloidal graphite (25% solids) and approximately 150 mL of distilled water was added to a beaker. A 0.5 g sample of Reax 825E was added and the pH of solution was brought to ~2 with sulfuric acid. A 2 mL aliquot of aniline was added. Then 9.51 g of p-TSA was then added to the reaction mixture. The solution was then cooled to ~0° C. Sodium persulfate was added in a 1.1:1 mole ratio to aniline. The reaction was allowed to stir overnight. The solution was filtered by vacuum through a Whatman #4 filter paper and washed with distilled water. The cake was washed twice with 50 mL 1M p-TSA. The sample was dried under vacuum to press pellets for conductivity measurements and also to determine percent solids of the wet cake. The wet cake was then used in casting films for resistivity studies. The conductivity of the sample was determined to be 68 S/cm.

EXAMPLE 4

Synthesis of 70/30 GLP Doped with pTSA:

A 28.0 g sample of colloidal graphite (25% solids) and approximately 150 mL of distilled water was added to a beaker. A 0.75 g sample of Reax 825E was added and the pH of solution was brought to ~2 with sulfuric acid. A 3 mL aliquot of aniline was added. Then 14.27 g of p-TSA was then added to the reaction mixture. The solution was then cooled to ~0° C. Sodium persulfate was added in a 1.1:1 mole ratio to aniline. The reaction was allowed to stir overnight. The solution was filtered by vacuum through a Whatman #4 filter paper and washed with distilled water. The cake was washed twice with 50 mL 1M p-TSA. The samples were dried under vacuum to press pellets for conductivity measurements and also to determine percent solids of the wet cakes. The wet cake was then used in casting films for resistivity studies. The conductivity of the sample was determined to be 53 S/cm.

Films of the composites were cast in Resimene 735 (Monsanto), a water-compatible formaldehyde based resin, according to ratios of conductive solids to total solids. The ratio of conductive solids to total solids varied from about 0.1 to 0.9 although this ratio may preferably range from about 1 to 99, more preferably from about 1 to 90 weight percent. Once the resin and sample were mixed, the wet film was applied at a thickness of 15 mils to the slide using a draw-down bar. The slides were cured in an oven at 125° C. for approximately 5 minutes.

Film resistivity studies were conducted on the composites synthesized with p-TSA as the dopant. FIG. 2 shows the results of the GLP containing films. The presence of the ICP appears to be the main factor in achieving low resistivities. The 70/30 composites gave lower resistivities than the 80/20 composites for all but three data points for the two figures (FIG. 2). This is especially significant because the 80/20 composites show higher bulk conductivities (GLP-68 S/cm) than the 70/30 (GLP-53 S/cm) composites. It is believed the greater amount of ICP homogenized in the graphite in the 70/30 composite was responsible for low resistivity values concomitant with low conductivity values. Thus, the greater amount of ICP resulted in the anomalous lower resistivity and lower conductivity values.

EXAMPLE 5

Synthesis of Carbon Black/LIGNO-PANI (CBLP) Composites were Prepared as Follows.

KETJENBLACK EC-600 JD was obtained from Akzo Nobel. Sodium lignosulfonate (Reax 825E) was obtained from Westvaco. Aniline was purchased from Aldrich and distilled before use. Varying ratios for the ternary system were used, for example, the weight ratio of aniline:lignosulfonate:carbon black for the most conductive sample was 0.25:1:3. FIG. 3 demonstrates other viable ratios. The carbon black and lignin were added to 65 ml of an 8% isopropyl alcohol (IPA) in $H_2O$ solution. The resulting slurry was heated to 40° C. for approximately 40 minutes. The slurry was then allowed to cool to room temperature at which time the oxidant (sodium persulfate, Aldrich) was added to the slurry in a 1:1 molar ratio of oxidant to aniline. After 10 minutes the aniline was added to the slurry and was allowed to polymerize overnight. The solution was then vacuum filtered through Whatman #4 filter paper and washed with water, followed by a wash with an acid of choice, and a final wash with water. Film preparation and determination of bulk conductivity and film resistivity were carried out in substantially the same manner described above. FIG. 3 demonstrates the range of conductivities of CBLP composites.

EXAMPLE 6

Synthesis of Sulfonated Asphalt/Polyaniline (SAP) Composites were Also Prepared as Follows.

Sulfonated asphalt was obtained from Chevron Phillips and dissolved in water, then vacuum filtered to remove insolubles. The filtrate was then determined to contain 51.85% sulfonated asphalt. The soluble sulfonated asphalt was then added to a solution of 1 M methanesulfonic acid (HMSA) in a weight ratio of 1:4 to aniline. After cooling to 0° C. the sodium persulfate was added in a 1:1 molar ratio to aniline. The solution was reacted for 2 hrs, then filtered in a manner similar to the GLP composites described above. Film preparation and determination of bulk conductivity and film resistivity were carried out in substantially the same manner as described above. The conductivity of this sample was 15/cm. It should be noted the conductivity value may preferably range from about 10 to 30 S/cm.

All publications, patents, and patent documents are incorporated by reference herein, as though individually incorporated by reference. Although the invention has been described with reference to a specific and preferred embodiment and technique, it should be appreciated by one of skill in the art that many variations and modifications may be made within the scope of this invention.

What is claimed:

1. A composite consisting essentially of a conductive carbon material and lignosulfonic acid-doped polyaniline, wherein said composite possesses a conductivity greater than the conductivity of said polyaniline, and wherein the conductive carbon material comprises graphite comprising at least 60 weight percent of the composite.

2. The composite of claim 1 wherein the graphite comprises at least about 70 weight percent of the composite.

3. The composite of claim 1 wherein the graphite comprises at least about 80 weight percent of the composite.

4. The composite of claim 1 wherein the graphite comprises at least about 90 weight percent of the composite.

5. A method of preparing a conductive carbon material-lignosulfonic acid-doped polyaniline composite comprising polymerizing aniline in the presence of materials consisting essentially of the conductive carbon material and lignosulfonate, wherein the conductive carbon material comprises graphite comprising at least 60 weight percent of the composite.

6. The method of claim 5 wherein the graphite comprises at least about 70 weight percent of the composite.

7. The method of claim 6 wherein the graphite comprises at least about 80 weight percent of the composite.

* * * * *